US005078037A

United States Patent [19]

Sutcliffe et al.

[11] Patent Number: 5,078,037

[45] Date of Patent: Jan. 7, 1992

[54] STRINGED INSTRUMENT WITH SLOTTED BODY

[75] Inventors: Charles D. Sutcliffe; David P. Schafer, both of Newark, Del.

[73] Assignee: Dana Sound Research, Inc., Newark, Del.

[21] Appl. No.: 538,260

[22] Filed: Jun. 14, 1990

[51] Int. Cl.[5] ..... G10D 3/00

[52] U.S. Cl. ..... 84/291

[58] Field of Search ..... 84/291, 292, 293, 308

[56] References Cited

U.S. PATENT DOCUMENTS

| | | | |
|---|---|---|---|
| 36,308 | 5/1903 | Brown | D17/14 |
| 45,566 | 4/1914 | Longobardi | D17/14 |
| 3,482,028 | 12/1969 | Albert et al. | 84/722 |
| 4,359,923 | 11/1982 | Brunet | 84/291 |
| 4,856,403 | 8/1989 | Davies | 84/291 |

*Primary Examiner*—Brian W. Brown

*Attorney, Agent, or Firm*—Senniger, Powers, Leavitt & Roedel

[57] ABSTRACT

An improved stringed musical instrument of the type comprising a body, a neck extending from one end of the body and terminating in a headstock. The neck is divided along its length into a plurality of frets. A plurality of strings extend over the body along the neck to the headstock. There is a hand slot in the body, extending inwardly from the periphery of the body to a point closely adjacent the neck, and sized to provide access to the frets at the base of the neck. The slot curves along its length. Preferably, the slot underlies a portion of at least some of the strings.

17 Claims, 1 Drawing Sheet

STRINGED INSTRUMENT WITH SLOTTED BODY

BACKGROUND OF THE INVENTION

This invention relates to stringed musical instruments of the type comprising a body, a neck extending from one end of the body, and plurality of strings extending over the body and along the neck.

Most stringed instruments comprise a body, a neck extending from one end of the body, and a plurality of strings mounted on the instrument over the body and along the neck. The neck is usually divided by a plurality of frets. The strings are manipulated over the body and over the neck to form various sounds. Usually the strings are held against various frets and simultaneously caused to vibrate, for example by picking, strumming or bowing. Some examples of this type of stringed instrument are guitars and basses.

Frequently, the base or end of the neck overlaps a portion of the body. Accessing the frets at the base of the neck is very difficult. As shown in U.S. Pat. No. 4,856,403, at least one attempt has been made to improve access to the frets at the base of the neck. However, this attempt did little for the appearance of the instrument, did not provide complete access to the frets, and did not improve access to the individual strings in the area around the base of the neck.

SUMMARY OF THE INVENTION

It is among the objects of the present invention to provide a stringed musical instrument of the type comprising a body, and a neck, divided by a plurality of frets, extending from one end of the body, in which the frets at the base are more easily accessible; to provide such an instrument in which the strings in the area around the base of the neck are more easily accessible, and to provide such an instrument that is of unique and attractive appearance.

Generally this invention relates to stringed musical instruments of the type comprising a body, a neck extending from one end of the body and terminating in a headstock, the neck being divided along its length by a plurality of frets, and a plurality of strings extending over the body along the neck to the headstock. According to this invention, the instrument further comprises a hand slot in the body, extending inwardly from the periphery of the body to a point closely adjacent the neck, and sized to provide access to the frets at the base of the neck.

The hand slot extends under at least some of the strings so that the slot underlies at least a portion of some of the strings. The slot preferably curves along its length, curving around the base of the neck. The hand slot is preferably located in the lower portion of the instrument, extending generally vertically upwardly when the instrument is held in a normal horizontal playing position.

The hand slot improves access to the frets at the base of the neck. The slot also improves access to the strings in the area of the base of the neck. The location of the slot allows the musician smooth, continuous, and quick access to the neck. Finally, the hand slot provides a unique and attractive feature on the body.

These and other advantages will be in part apparent and in part pointed, out hereinafter.

BRIEF DESCRIPTION OF THE DRAWINGS

Corresponding reference numerals indicate corresponding parts throughout the several views of the drawings.

DETAILED DESCRIPTION OF THE PREFERRED EMBODIMENT

Figure 1:
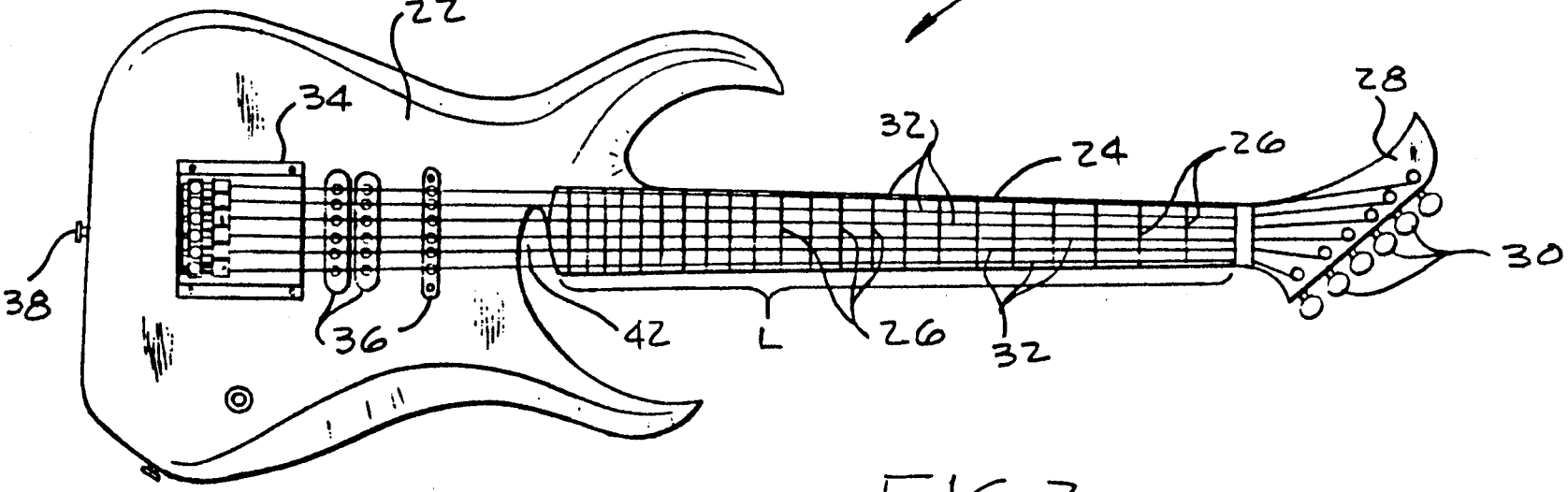
FIG. 1 is a front elevation view of a guitar constructed according to the principles of this invention.
Figure 2:
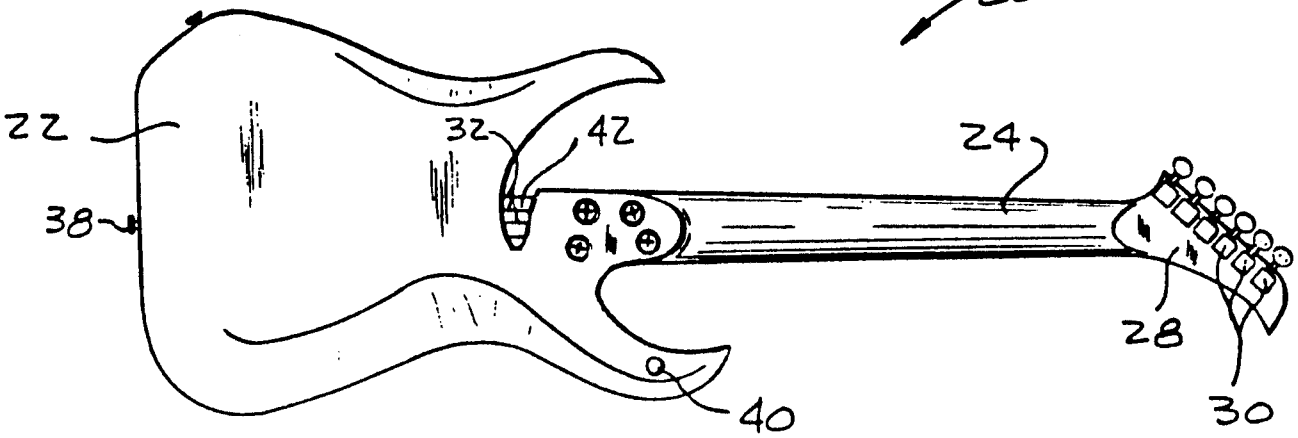
FIG. 2 is a rear elevation view of the guitar.

This invention relates to stringed instruments of the type comprising a body, a neck extending from one end of the body and terminating in a headstock, the neck being divided along its length by a plurality of frets, and a plurality of strings extending over the body along the neck to the headstock. This type of stringed instrument generally includes guitars and basses. The invention is described in this Preferred embodiment as it applies to a guitar, but it is not so limited, and applies equally to basses and other stringed musical instruments.

A guitar constructed according to the principles of this invention is indicated generally as 20 in the FIGS. The guitar 20 comprises a body 22, and a neck 24 extending from one end of the body. Typically, the neck 24 is a separate piece having first and second ends. The first end is mounted over a portion of one end of the body, so that the body generally surrounds the first end of the neck. The neck is divided along its length by a plurality of frets 26, and terminates at its free, second end in a headstock 28 having a plurality of string tightening units 30. A plurality of strings 32 are mounted on the instrument, extending over the body and along the neck to the headstock 28. As is well known in the art, the body 22 carries a tail piece and bridge 34, and a plurality of pickups 36. The guitar includes buttons 38 and 40 for attaching a strap to the guitar to hang or suspend the guitar from the neck and shoulders of the musician.

According to the principles of this invention, the guitar 20 includes a hand slot 42 in the body, extending inwardly from the periphery of the body to a point closely adjacent the neck. The slot is sized to provide access to the frets 26 at the base of the neck 24. The slot 42 preferably curves along its length, and as shown in FIG. 1 preferably curves around the base of the neck 24, extending underneath at least some of the strings, so that the slot underlies a portion of at least some of the strings 32. The slot 42 improves access to the frets at the first end of the neck. The slot 42 allows the use of the same fingering and wrist position along the entire length of the neck. Unlike prior guitars where the wrist might have to be turned or the finger positions changed, the guitar of the present invention allows the same hand position to be used along the entire neck. This results in more consistent and more accurate playing. It also reduces strain on the musician's hand, resulting in more comfortable play. The slot 42 also improves access to the strings in the area around the base of the neck, particularly by the musician's fretting hand.

The slot 42 is preferably located in the lower portion of the instrument, i.e. when the guitar 20 is supported in its generally horizontal playing position with the strings extending generally horizontally and dividing the body into upper and lower portions, the slot 42 is in the lower portion.

The body 22 of the guitar 22 is preferably configured so that when the guitar is held in its generally horizontal playing position the lower edge L of the neck 24 is exposed for its entire length. The slot 42 extends generally vertically inwardly from the periphery of the body, closely adjacent to the base of the neck, curving at least partway around the base of the neck. Because of the smooth, curved configuration of the slot 42, the slot provides smooth, continuous, and quick access to the entire neck. The musician can readily slide his or her hand along the neck into and out of the slot 42.

OPERATION

The guitar 20 is played like a conventional guitar. However, the slot allows the musician to conveniently move his or her fretting hand the entire length of the neck, including conveniently accessing the frets at the base of the neck. The slot 42 allows the musician to use the same fingering and wrist position along the entire length of the neck. It is not necessary to turn the wrist or otherwise contort the hand to reach the frets at the base of the neck. This ability to reach all the frets without changing the playing position results in more consistent and accurate fingering, and more comfortable play. The slot 42 also allows the musician to conveniently access the strings in the area of the base of the neck, if desired.

Finally, the slots gives the guitar 20 and unique and distinctive appearance.

In view of the above, it will be seen that the several objects of the invention are achieved and other advantageous results attained.

As various changes could be made in the above constructions without departing from the scope of the invention, it is intended that all matter contained in the above description or shown in the accompanying drawings shall be interpreted as illustrative and not in a limiting sense.

What is claimed is:

1. An improved stringed musical instrument of the type comprising a body, a neck having a first end and a second end, the first end of the neck being attached to the body, the neck extending from the body and terminating in a headstock, the neck being divided along its length by a plurality of frets, and a plurality of strings extending over the body along the neck to the headstock, the improvement comprising:

a slot through the body, the slot extending inwardly from the periphery of the body and between the first end of the neck and the remainder of the body.

2. The improved stringed musical instrument according to claim 1 wherein the slot curves along its length.

3. The improved stringed musical instrument according to claim 2 wherein the slot curves at least partway around the first end of the neck.

4. The improved stringed musical instrument according to claim 1 wherein the instrument is adapted to be supported in a generally horizontal playing position, with the strings extending generally horizontally and dividing the body into upper and lower portions, and wherein the slot is in the lower portion of the body.

5. The improved stringed musical instrument according to claim 4 wherein the slot extends generally vertically.

6. The improved stringed musical instrument according to claim 4 wherein the body is configured so that the lower edge of the neck is exposed for its entire length.

7. An improved stringed musical instrument of the type comprising a body, a neck having a first end and a second end, the first end being attached to the body, the neck extending from the body and terminating in a headstock, the neck being divided along its length by a plurality of frets, and a plurality of strings extending over the body, along the neck to the headstock, the improvement comprising:

a hand slot through the body, the slot extending inwardly from the periphery and between the first end of the neck and the remainder of the body, the slot directly underlying at least a portion of some of the strings.

8. The improved stringed musical instrument according to claim 7 wherein the hand slot curves along its length.

9. The improved stringed musical instrument according to claim 8 wherein the hand slot curves at least partway around the first end of the neck.

10. An improved stringed musical instrument of the type comprising a body, a neck having first and second ends, the first end of the neck being mounted on the body with the neck projecting outwardly therefrom, the neck being divided by a plurality of frets, a headstock on the second end of the neck, and a plurality of strings extending over along the neck to the headstock, the improvement comprising:

a hand slot through the body, the slot extending inwardly from the periphery of the body and between the first end of the neck and the remainder of the body to a point closely adjacent the first end of the neck to provide access to the frets at the first end of the neck.

11. The improved stringed musical instrument according to claim 10 wherein the hand slot curves along its length.

12. The improved stringed musical instrument according to claim 11 wherein the hand slot curves around the first end of the neck.

13. The improved stringed musical instrument according to claim 10 wherein the musical instrument is adapted to be supported in a generally horizontal playing position, with the strings extending generally horizontally and dividing the body into upper and lower portions, and wherein the hand slot is in the lower portion of the body.

14. The improved stringed musical instrument according to claim 13 wherein the body is configured so that the lower edge of the neck is exposed for its entire length.

15. An improved stringed musical instrument of the type comprising a body, a neck having first and second ends, the first end of the neck being mounted on the body with the neck projecting outwardly therefrom, the neck being divided by a plurality of frets, a headstock on the second end of the neck, and a plurality of strings extending over along the neck to the headstock, the improvement comprising:

a curved hand slot through the body, the slot extending inwardly from the periphery of the body, between the first end of the neck and the remainder of the body and directly underneath at least a portion of some of the strings.

16. The improved stringed musical instrument according to claim 15 wherein the musical instrument is adapted to be supported in a generally horizontal playing position, with the strings extending generally horizontally and dividing the body into upper and lower portions, and wherein the hand slot is in the lower portion of the body.

17. The improved stringed musical instrument according to claim 16 wherein the body is configured so that the lower edge of the neck is exposed for its entire length.

* * * * *